US006609762B2

(12) United States Patent
Anderson

(10) Patent No.: US 6,609,762 B2
(45) Date of Patent: Aug. 26, 2003

(54) WALK BEHIND FLOOR STRIPPING MACHINE WITH HYDRAULIC DRIVE

(76) Inventor: Martin L. Anderson, 6852 Estes Ave. NW., Maple Lake, MN (US) 55358

( * ) Notice: Subject to any disclaimer, the term of this patent is extended or adjusted under 35 U.S.C. 154(b) by 0 days.

(21) Appl. No.: 09/880,532

(22) Filed: Jun. 13, 2001

(65) Prior Publication Data

US 2002/0190568 A1 Dec. 19, 2002

(51) Int. Cl.[7] ..... B32B 35/00
(52) U.S. Cl. ..... 299/37.2; 299/36.1
(58) Field of Search ..... 299/36.1, 37.1, 299/41.1; 180/19.1, 19.3

(56) References Cited

U.S. PATENT DOCUMENTS

| | | | | | |
|---|---|---|---|---|---|
| 4,162,809 | A | | 7/1979 | Anderson et al. | 299/37 |
| 4,394,052 | A | * | 7/1983 | Adams et al. | 242/539 |
| 4,645,264 | A | * | 2/1987 | Morrison | 165/41 |
| 4,787,195 | A | * | 11/1988 | Wenzel | 56/11.1 |
| 4,856,264 | A | * | 8/1989 | Nishimura et al. | 56/10.8 |
| 5,119,744 | A | * | 6/1992 | Comer | 111/127 |
| 5,137,100 | A | * | 8/1992 | Scott et al. | 180/19.1 |
| 5,426,805 | A | * | 6/1995 | Fisher | 15/79.2 |
| 5,741,047 | A | * | 4/1998 | Ordonez | 299/37.1 |
| 5,890,772 | A | * | 4/1999 | Mravyan | 175/374 |
| 6,135,566 | A | | 10/2000 | Anderson | 299/37.1 |
| 6,142,171 | A | * | 11/2000 | Hancock | 137/271 |

* cited by examiner

*Primary Examiner*—Heather Shackelford
*Assistant Examiner*—John Kreck
(74) *Attorney, Agent, or Firm*—Thomas J. Nikolai; Nikolai & Mersereau, P.A.

(57) ABSTRACT

A hydraulically powered self-propelled stripping machine having an electric motor for providing oscillating motion to a cutting head member. The electric motor driving a hydraulic pump for pumping hydraulic fluid to a hydraulic motor for driving the wheels of the hydraulically powered self propelled stripping machine. The hydraulic system having forward and reverse as well as speed control valves for controlling the direction and speed of the hydraulically powered wheels or for stopping. The hydraulically powered self-propelled stripping machine also having a hydraulic pressure safety valve for protecting the machine and the objects it engages from damage.

22 Claims, 4 Drawing Sheets

WALK BEHIND FLOOR STRIPPING MACHINE WITH HYDRAULIC DRIVE

BACKGROUND OF THE INVENTION

1. Field of the Invention

This invention relates to machines for stripping materials, such as adhesive bonded floor coverings from floor surfaces, and more particularly to a machine of this type incorporating an electric motor drive system for moving the machine's cutting head in an orbital pattern and a hydraulic system for driving its wheels and thereby allowing an easier to control, variable speed machine for floor stripping.

2. Description of the Related Art

U.S. Pat. No. 4,162,809 issued Jul. 31, 1979 for a motorized carpet and tile stripping machine that comprises a box-like housing mounted on a pair of wheels disposed near the rear of the housing and a cutting blade projecting outwardly from the front of the housing and adapted to engage the ground beneath a floor covering adhesively bonded to the floor. Supported on an upper deck of the housing is an electric motor whose output shaft is coupled to the machine's cutting head by means of an eccentric drive shaft such that the cutting head is made to move in an orbital or elliptical pattern. An elongated handle is affixed to the upper deck of the housing and slopes rearward and upward terminating in handle grips. However the stripper had to be propelled by the force applied to the handles by a user. The strippers were heavy and hard to handle.

Self-propelled floor stripping machines such U.S. Pat. No. 6,135,566 issued on Oct. 24, 2000 were introduced to provide powered drive wheels reducing the user's task to steering the floor stripper machine instead of pushing and steering. However there were several drawbacks to the self-propelled floor stripping machine. The speed of the floor stripping machine was not easily changed, a belt would have to be moved to a different diameter portion of a pulley wheel leading into a gear reduction box to change the speed and there were only 3 speeds to select from. The floor stripper would have to be shut off to switch from forward to reverse. The floor stripper did not have a neutral to disengage the drive wheels so that the machine could be easily pushed. Additionally the floor stripper did not have a safety feature to stop the machine in case it was meeting a high resistance such as from snagging or getting caught on something.

Further a clutch mechanism was required to operate the wheels in conjunction with the cutting head member, which would cause jerky starts. Numerous gears, belts, bearings and drive shafts were needed to provide power to the drive wheels. All these parts where difficult to assemble, and keep in repair. Further they were noisy and reduced the power actually delivered to the drive wheels making the stripper less power efficient.

SUMMARY OF THE INVENTION

The self-propelled floor stripping machine provides a hydraulic motor for easily selecting a speed for the self-propelled floor stripping machine as well as providing for forward and reverse direction controls without having to stop the machine to change belts, drums or make other mechanical changes. The hydraulic motor provides power to the drive wheels of the floor stripper while the electric motor provides power to the continuously operating cutting head member. The electric motor also drives a hydraulic pump for operating the hydraulic motor. The hydraulic system replaces the cumbersome clutch, gears, pulleys, belts, bearings drive shafts and other mechanical drive mechanism parts of prior self-propelled floor stripping machines and improves the ease of use of the machine. The hydraulically driven self-propelled floor stripping machine can select from a continuum of forward or reverse speeds by opening or closing a valve. The self-propelled floor stripping machine can be set to neutral allowing the drive wheels to spin freely thus allowing the self-propelled floor stripping machine to be wheeled easily by the user.

The hydraulic system uses less electricity than a mechanical system which is of benefit where the capacity of electric power is limited at a site. Further the hydraulic self-propelled floor stripping machine helps conserve electrical energy and costs less to operate.

The hydraulic self-propelled floor stripping machine has a safety feature where a hydraulic valve can open for stopping the machine when it encounters a high resistance and protect parts from being overstressed.

OBJECTS OF THE INVENTION

It is an object of the invention to provide a variable speed self-propelled floor-stripping machine with a continuum of speeds to select from.

It is an object of the invention to provide a self-propelled floor stripping machine which is easily changed from forward to reverse without shutting the machine off.

It is an object of the invention to provide self-propelled floor-stripping machine with a neutral drive wheel feature to move the machine easily without power.

It is an object of the invention to provide a safety value in the hydraulics to prevent the machine from use of excessive force when engaging an object.

It is an object of the invention to provide a hydraulic safety valve to protect the machine from being overstressed.

It is an object of the invention to provide a machine that operates with lower electrical power consumption.

It is an object of the invention to provide a hydraulically powered floor stripping machine.

It is an object of the invention to provide a quieter floor stripping machine.

It is an object of the invention to provide a lower cost floor stripping machine.

It is an object of the invention to provide a more reliable floor stripping machine.

It is an object of the invention to provide a longer lasting floor stripping machine.

It is an object of the invention to eliminate clutches and other mechanical parts in a floor stripping machine.

Other objects, advantages and novel features of the present invention will become apparent from the following detailed description of the invention when considered in conjunction with the accompanying drawing.

DESCRIPTION OF THE PREFERRED EMBODIMENTS

Figure 1:
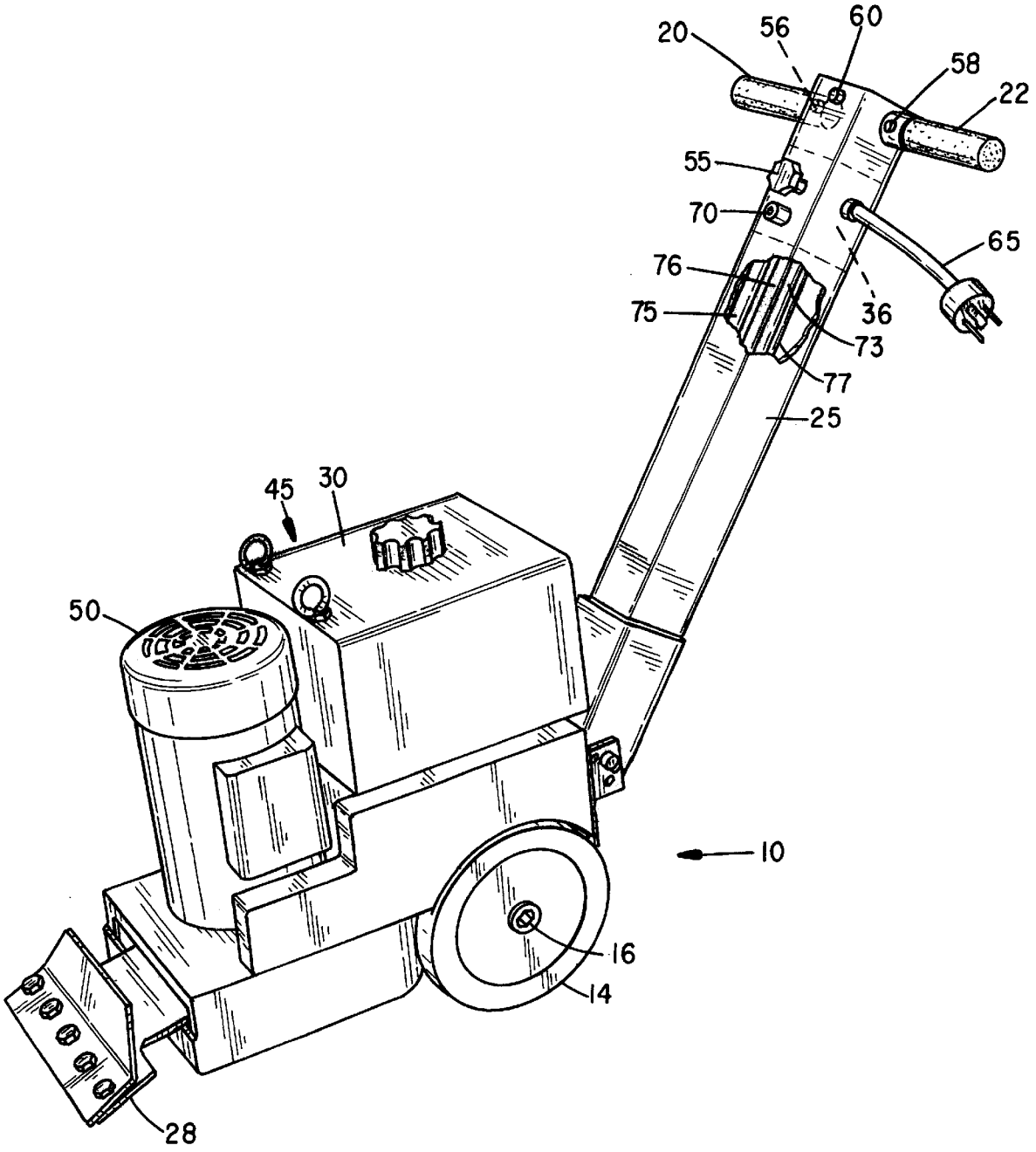
FIG. 1 is a perspective view of the floor stripping machine.
Figure 2:
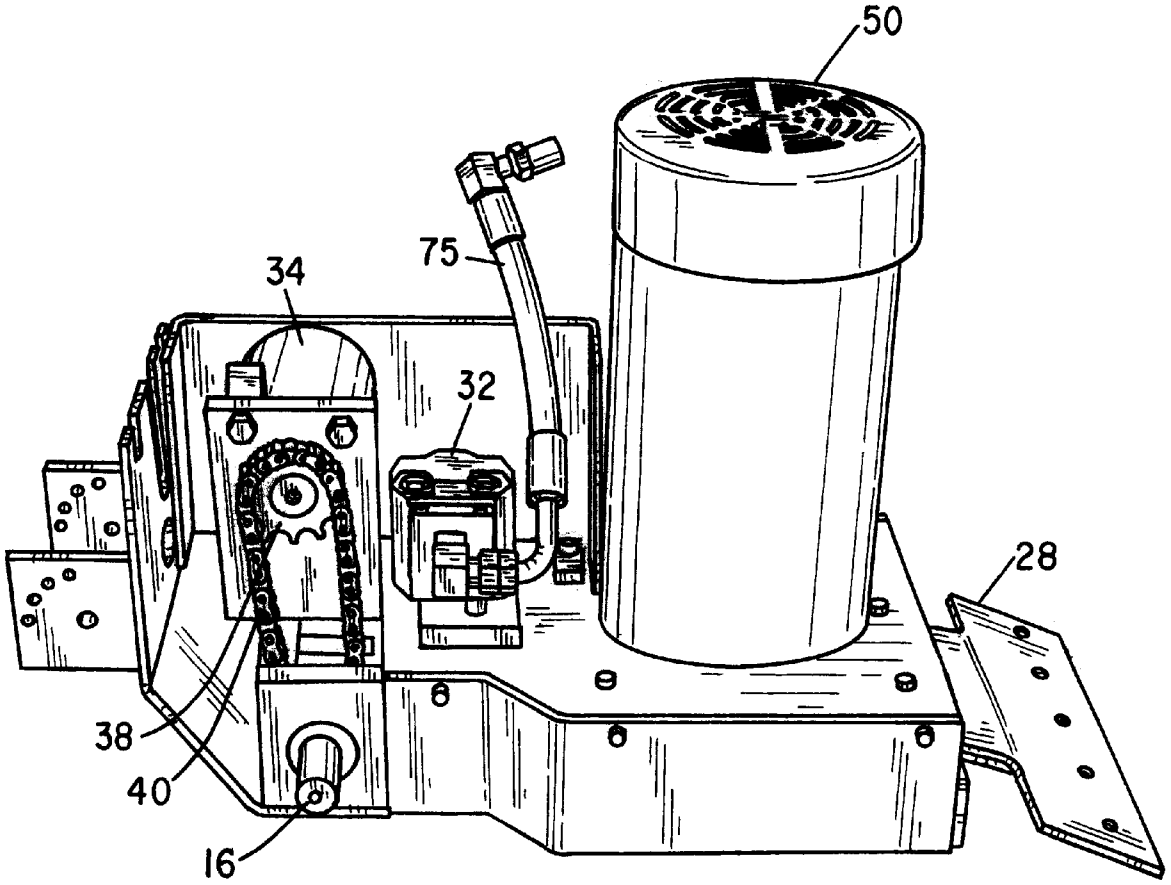
FIG. 2 is a perspective view of the drive mechanism of the floor stripper machine.

The self propelled floor stripping machine 10 has a main body portion 45 having a cutting head member 28 in the front for removing carpeting and other objects attached to a floor or other generally flat surface. The cutting head member 28 is driven by electric motor 50 and is mechanically connected thereto by a shaft having an eccentric portion for moving the cutting head member 28 in an orbital motion. For a detailed view of such a mechanical connection see U.S. Pat. No. 6,135,566, which is hereby attached hereto and made a part hereof by reference. As best seen in FIG. 2, the drive wheels 14 are powered by a hydraulic motor 34 which turns sprocket wheel 38 connected to drive chain 40 which is connected to drive shaft 16 on which wheel 14 is mounted. The hydraulic motor 34 is powered by a hydraulic connection between the hydraulic motor 34 and pump 32. Pump 32 is driven by a mechanical connection to electric motor 50.

Figure 3:
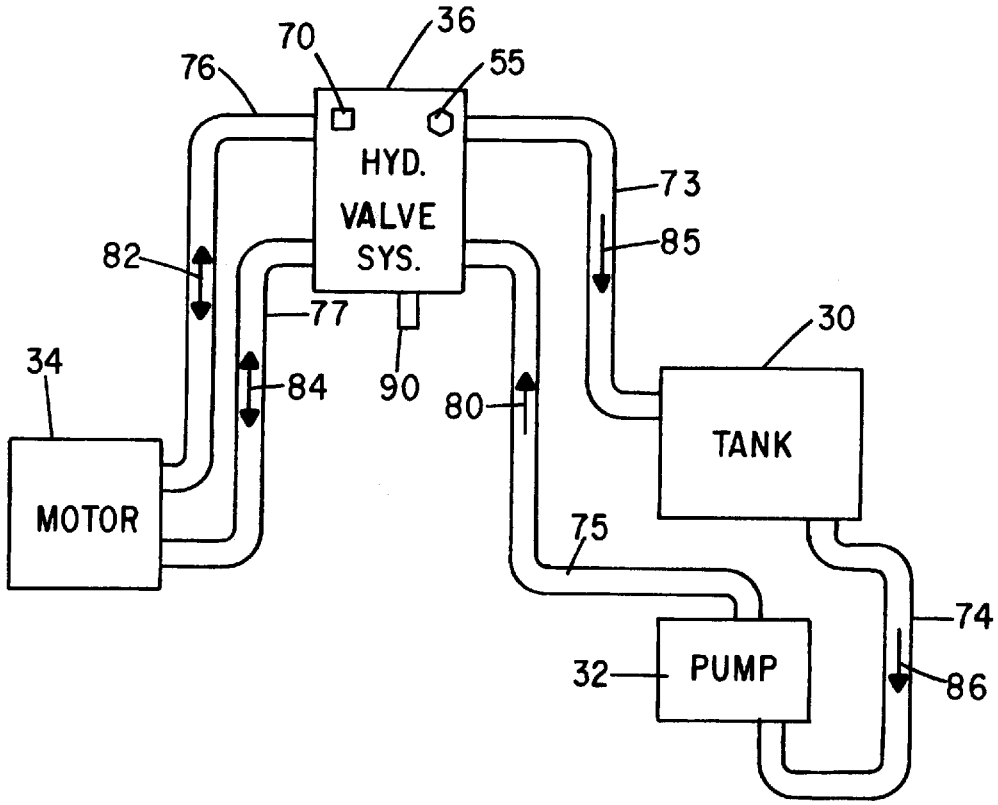
FIG. 3 is a schematic view of the hydraulic system in the floor stripper machine.
Figure 4:
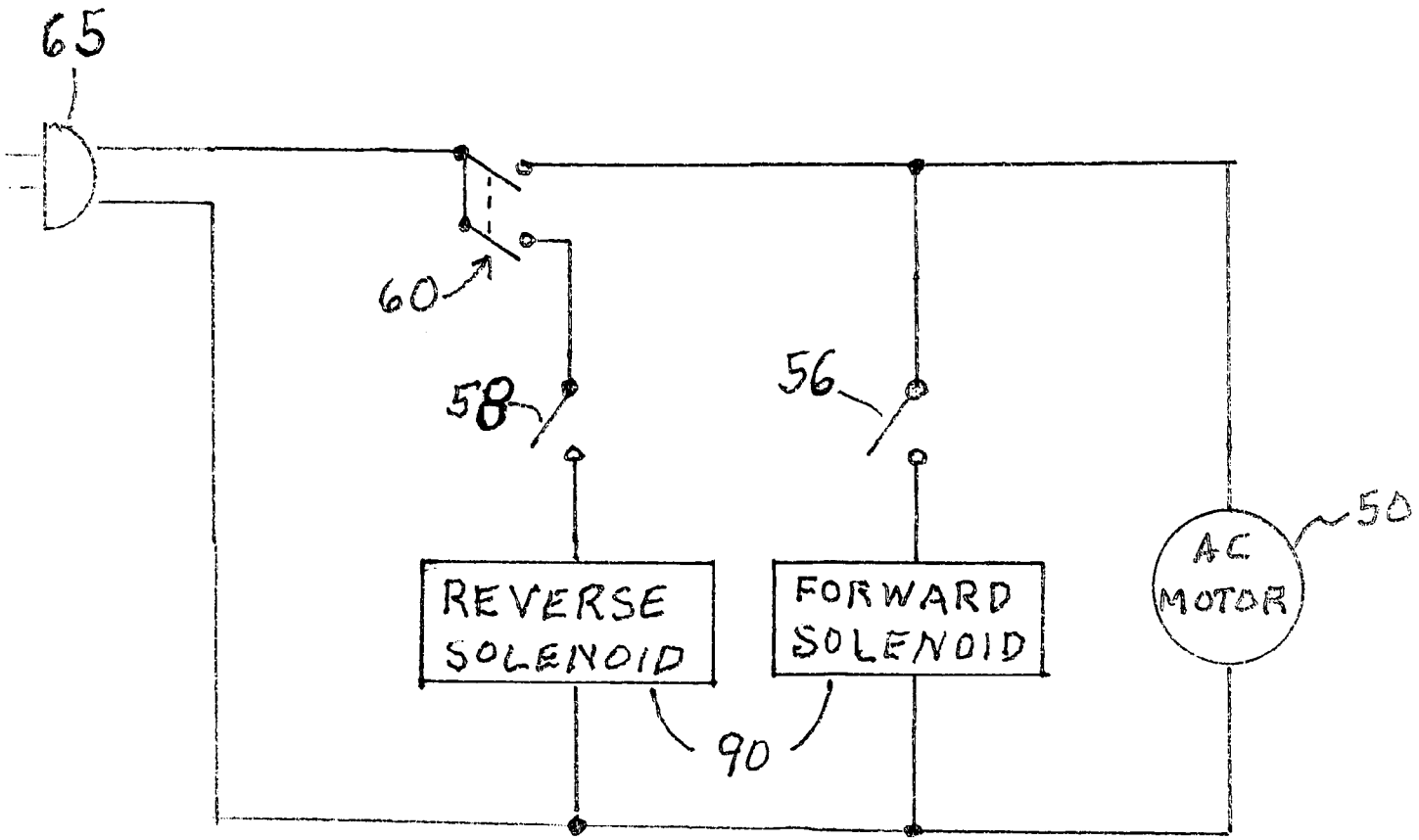
FIG. 4 is a further schematic drawing showing the electrical circuit used in the machine.

The hydraulic system for the self-propelled stripping machine 10 is shown in FIG. 3. It has a pump 32 connected by a hydraulic line 75 for pumping hydraulic fluid in the direction shown by arrow 80 to hydraulic valve system 36 which controls the speed of the self-propelled stripping machine by use of flow control valve 55, as well as the forward, reverse by use of solenoid valves 90. The hydraulic fluid can be controlled by valves in the hydraulic valve system 36 to flow to the hydraulic motor 34 either through hydraulic line 76 or 77 so as to make the hydraulic motor 34 spin either in a clockwise or counter clockwise direction for driving the self-propelled stripping machine 10 selectively in the forward or reverse modes as desired. By use of proper valving the hydraulic fluid can flow in hydraulic lines 76 and 77 in either direction as indicted by arrows 82 and 84 as is well understood by those skilled in the art of hydraulics. The hydraulic system also has a pressure relief valve 70 for safety to protect the hydraulic system and limit the force applied by the self-propelled stripping machine 10 itself and other objects.

The pump 32 obtains hydraulic fluid from tank 30, which acts as the hydraulic reservoir for the system, through hydraulic line 74 with the hydraulic fluid flowing in the direction shown by arrow 86.

The hydraulic circuit is completed by hydraulic fluid flowing from the hydraulic valve system 36 to tank 30 with hydraulic fluid flowing in direction shown by arrow 85 in hydraulic line 73.

The hydraulic valve system 36 controls the flow rate and direction of the hydraulic fluid to hydraulic motor 34 for propelling the self-propelled stripping machine. The controls for the hydraulic valve system 36 are the flow control knob 55 on handle 25 to allow greater of lesser volumes of hydraulic fluid to flow to the hydraulic motor 34 thereby controlling the speed of the self propelled stripper machine 10. If no hydraulic fluid flows to the hydraulic motor 34 the self-propelled stripping machine 10 is stopped. As flow increases to the hydraulic motor 34 the speed of the self-propelled stripping machine 10 increases.

The hydraulic valve system 36 can be located in the handle 25 with hydraulic lines 73, 75, 76 and 77 leading thereto. Alternatively the hydraulic valve system 36 can be on the main body 45 of the self-propelled striping machine 10.

The hydraulic valve control 36 controls the direction of the flow of hydraulic fluid in the hydraulic lines to the hydraulic motor 34 for controlling the forward or reverse movement of the self-propelled stripping machine 10. Electrical switches 56 and 58 activate solenoid valves (90) in the hydraulic valve controls 36 to select the direction of motion of the self-propelled stripping machine. For example switch 56 on handle bar 20 on handle 25 may be pressed for forward motion of the self-propelled stripping machine 10. Alternatively switch 58 on handle bar 22 on handle 25 may be pressed for backward motion of the self-propelled stripping machine 10.

The electric power for the self-propelled stripping machine 10 may be supplied through a power cord 65 and be controlled by an on-off switch 60. Optionally batteries, or some other source of electricity may also be used to provide power to the electric motor 50. Alternatively the electric motor 50 may be replaced by other types of motors using fuels or other sources of energy to power the pump 32.

The hydraulic lines 73, 75, 76, 77 and the hydraulic valve control 36 of the embodiment shown are in the handle 25 with the speed control valve 55 is directly connected thereto. A pressure relief valve 70 used in the hydraulic valve controls 36 provides a measure of safety for the self-propelled stripping machine 10 in that when pressure in the hydraulic lines builds up too highs the valve 70 will relieve the pressure build up. The relief of pressure will save the self-propelled stripping machine 10 from overstressing itself and stop the machine 10 from damaging objects coming in contact with the self-propelled stripping machine 10. For example if the self-propelled stripping machine 10 were to snag on something it would stop before causing large amounts of damage.

The hydraulic valve control can be configured such that the hydraulic motor 34 will not receive fluid flow in either direction. The wheels 14 can then be moved freely when it is desired to push the self-propelled stripping machine 10 by hand. The electric motor 50 can run when the self-propelled stripping machine 10 is idle. In this mode the hydraulic fluid can circulate from the pump 32 to the tank 30 thus reducing the heat of the hydraulic fluid and the work of the electric motor 50 when the self-propelled stripping machine 10 is stopped. The electric motor 50 can then run at a lower temperature and use less electricity while the self-propelled stripping machine 10 is not being propelled under its own power with the electric motor 50 on.

U.S. Pat. No. 6,135,566 was incorporated by reference since many of the features of the '566 patent are the same in the hydraulic powered self-propelled stripping machine of the present application. The electric motor connection to drive the wheels of the self-propelled stripping machine in the '566 patent having mechanical connections with a clutch, gears and belts has been replaced with the hydraulic system as shown and described above.

Obviously, many modifications and variations of the present invention are possible in light of the above teachings. It is therefore to be understood that, within the scope of the appended claims, the invention may be practiced otherwise than as specifically described.

What is claimed is:

1. A self-propelled, walk-behind floor stripping machine for removing adhesively bonded floor coverings comprising:

a main body having a drive axle and a pair of drive wheels affixed to the drive axle;

a floor engaging cutting head member attached to the main body;

an electric motor mounted on said main body and mechanically connected to the cutting head member to provide a motion thereto;

a hydraulic pump attached to the main body and coupled to be driven by the electric motor, the hydraulic pump coupled to a hydraulic fluid reservoir attached to the main body, the hydraulic pump having a suction inlet coupled to the hydraulic fluid reservoir, and a pressure outlet coupled through a hydraulic valve to a hydraulic motor attached to the main body at a location offset from the drive axle, the hydraulic motor having an output shaft coupled to said drive axle for driving the pair of drive wheels.

2. The self-propelled, walk-behind floor stripping machine of claim 1 wherein the hydraulic valve controls the direction of rotation of the pair of drive wheels.

3. The self-propelled, walk-behind floor stripping machine of claim 2 wherein the hydraulic valve controls the speed of rotation of the pair of drive wheels.

4. The self-propelled, walk-behind floor stripping machine of claim 1 wherein the hydraulic valve controls the speed of rotation of the pair of drive wheels.

5. The self-propelled, walk-behind floor stripping machine of claim 1 where a handle is attached to the main body for steering and handle bars are attached to the handle.

6. The self-propelled, walk-behind floor stripping machine of claim 5 where the hydraulic valve and hydraulic lines connected thereto are in the handle.

7. A self-propelled, walk-behind floor stripping machine for removing adhesively bonded floor coverings as in claim 1 wherein, a speed control valve in the hydraulic valve system regulates the speed of the hydraulic motor.

8. A self-propelled, walk-behind floor stripping machine for removing adhesively bonded floor coverings as in claim 1 wherein, a pressure safety valve the hydraulic valve system relieves pressure in the hydraulic system.

9. A self-propelled, walk-behind floor stripping machine for removing adhesively bonded floor coverings as in claim 1 wherein, an electrical switch on the handle to turn on or turn off electricity running to the electric motor.

10. A self-propelled, walk-behind floor stripping machine, comprising:

a frame;

an axle having a pair of ground-engaging wheels thereon journaled for rotation on the frame;

a scrapper blade assembly resiliently mounted to the frame;

an electric motor mounted to the frame for imparting oscillatory movement to the scrapper blade assembly;

a hydraulic circuit including a hydraulic pump, a hydraulic fluid reservoir, a hydraulic motor and a control valve mechanism, the hydraulic pump being driven by the electric motor to circulate hydraulic fluid from the hydraulic fluid reservoir to the hydraulic motor via the control valve mechanism; and the hydraulic motor being affixed to the frame at a location offset from the axle and coupled in driving relation to the axle.

11. The self-propelled, walk-behind floor stripping machine of claim 10 wherein the control valve mechanism controls the direction of rotation of the pair of ground-engaging wheels.

12. The self-propelled, walk-behind floor stripping machine of claim 11 wherein the hydraulic valve mechanism controls the speed of rotation of the pair of drive wheels.

13. The self-propelled, walk-behind floor stripping machine of claim 12 wherein a safety valve in the hydraulic valve mechanism relieves pressure in the hydraulic circuit.

14. The self-propelled, walk-behind floor stripping machine of claim 12 wherein a valve in the hydraulic circuit provides hydraulic fluid flow from the pump to the tank while the electric motor powering the pump is running to lower the hydraulic fluid temperature and let the electric motor run cooler.

15. The self-propelled, walk-behind floor stripping machine as in claim 11 wherein a handle is attached to the main body for steering.

16. The self-propelled, walk-behind floor stripping machine as in claim 15 wherein, the control valve mechanism is in the handle.

17. The self-propelled, walk-behind floor stripping machine of claim 10 wherein the hydraulic valve mechanism controls the speed of rotation of the pair of ground engaging wheels.

18. The self-propelled, walk-behind floor stripping machine as in claim 10 and further including a handle member coupled at a first end to the frame and having first and second hand grips at a second end thereof and wherein said control valve mechanism and hydraulic lines are mounted in the handle.

19. The self-propelled, walk-behind floor stripping machine as in claim 18 wherein the control valve mechanism includes solenoid-operated cartridge valves and first and second control switches coupled in circuit with the solenoid-operated cartridge valves, the control switches being disposed on the first and second hand grip members, respectively.

20. The self-propelled, walk-behind floor stripping machine as in claim 19 wherein the control valve mechanism circulates hydraulic fluid from the hydraulic pump to the hydraulic fluid reservoir when neither of the first and second control switch is actuated.

21. The self-propelled, walk-behind floor stripping machine as in claim 18 wherein the control valve mechanism includes a control device for regulating the rate of flow of hydraulic fluid from the hydraulic pump to the hydraulic motor.

22. A self-propelled, walk-behind floor stripping machine for removing adhesively bonded floor coverings comprising:

a main body having a drive axle and a pair of drive wheels affixed to the drive axle;

a floor engaging cutting head member attached to the main body;

an electric motor mounted on said main body and mechanically connected to the cutting head member to provide a motion thereto;

a hydraulic pump attached to the main body and coupled to be driven by the electric motor, the hydraulic pump coupled to a hydraulic fluid reservoir attached to the main body, the hydraulic pump having a suction inlet coupled to the hydraulic fluid reservoir, and a pressure outlet coupled through a hydraulic valve to a hydraulic motor attached to the main body at a location displaced from the drive axle, the hydraulic motor having an output shaft coupled to said drive axle for driving the pair of drive wheels, a handle having a first end attached to the main body, the handle having a second end with a first handle bar and a second handle bar on opposite sides of the handle, an hydraulic valve system in the handle, a first hydraulic line running from the hydraulic pump to the hydraulic valve system, to provide pressurized hydraulic fluid to the hydraulic valve system, a second hydraulic line running from the hydraulic valve system, to the hydraulic reservoir to return the hydraulic fluid to the hydraulic reservoir, a third hydraulic line running from the hydraulic valve system, to the motor for delivering hydraulic fluid for running the motor in a first direction, or returning the hydraulic fluid to the hydraulic valve system, a fourth hydraulic line running from the hydraulic valve system, to the motor for delivering hydraulic fluid for running the motor in a second direction, or returning the hydraulic fluid to the hydraulic valve system, the first handle bar having an electrical switch connected to a solenoid for activating a control valve in the hydraulic valve system to run the hydraulic motor in the first direction, the second handle bar having an electrical switch for connected to the solenoid for activating the control valve in the hydraulic valve system to run the hydraulic motor in the second direction.

* * * * *

US006609762C1

(12) EX PARTE REEXAMINATION CERTIFICATE (8529th)

United States Patent
Anderson

(10) Number: US 6,609,762 C1
(45) Certificate Issued: Sep. 13, 2011

(54) WALK BEHIND FLOOR STRIPPING MACHINE WITH HYDRAULIC DRIVE

(75) Inventor: Martin L. Anderson, Maple Lake, MN (US)

(73) Assignee: National Flooring Equipment, Inc., Minneapolis, MN (US)

Reexamination Request:
No. 90/010,737, Nov. 11, 2009

Reexamination Certificate for:

| | |
|---|---|
| Patent No.: | **6,609,762** |
| Issued: | **Aug. 26, 2003** |
| Appl. No.: | **09/880,532** |
| Filed: | **Jun. 13, 2001** |

(51) Int. Cl.
*A47L 13/08* (2006.01)

(52) U.S. Cl. ..... 299/37.2; 299/36.1
(58) Field of Classification Search ..... 299/36.1, 299/37.1, 37.2
See application file for complete search history.

(56) References Cited

U.S. PATENT DOCUMENTS

| | | | | |
|---|---|---|---|---|
| 2,519,138 | A | | 8/1950 | Katz |
| 2,942,677 | A | | 6/1960 | Gray |
| 3,074,090 | A | | 1/1963 | Thompson |
| 3,165,775 | A | | 1/1965 | Lutz |
| 3,222,706 | A | | 12/1965 | Kaar et al. |
| 3,246,715 | A | | 4/1966 | Pool |
| 3,251,629 | A | | 5/1966 | Cawley |
| 3,376,071 | A | | 4/1968 | Stein |
| 3,424,260 | A | | 1/1969 | Stone et al. |
| 3,563,608 | A | | 2/1971 | Crispino |
| 3,616,869 | A | | 11/1971 | Rilling |
| 3,882,679 | A | | 5/1975 | Williamson |
| 3,946,543 | A | | 3/1976 | Templeton |
| 4,053,183 | A | | 10/1977 | Probst |
| 4,078,574 | A | | 3/1978 | Kosarzecki |
| 4,162,809 | A | | 7/1979 | Anderson et al. |
| 4,301,881 | A | | 11/1981 | Griffin |
| 4,309,788 | A | | 1/1982 | Brager et al. |
| 4,310,198 | A | | 1/1982 | Destree |
| 4,348,783 | A | | 9/1982 | Swanson |
| 4,369,855 | A | | 1/1983 | Buschbom |
| 4,394,052 | A | | 7/1983 | Adams |
| 4,413,698 | A | | 11/1983 | Conrad |
| 4,457,036 | A | | 7/1984 | Carlson |
| 4,494,624 | A | | 1/1985 | Scheuerle |
| 4,571,941 | A | | 2/1986 | Aoyagi |
| 4,699,430 | A | | 10/1987 | Nichols |
| 4,819,430 | A | | 4/1989 | Becker |
| 4,888,949 | A | | 12/1989 | Rogers |
| 4,920,733 | A | | 5/1990 | Berrios |
| 5,197,784 | A | | 3/1993 | Holder |
| 5,426,805 | A | | 6/1995 | Fisher |
| 5,535,845 | A | | 7/1996 | Buschur |
| 5,641,206 | A | | 6/1997 | Craft |
| 5,682,958 | A | | 11/1997 | Kalhorn |
| 5,702,161 | A | | 12/1997 | Finney et al. |
| 5,830,313 | A | | 11/1998 | Smith |
| 5,894,899 | A | * | 4/1999 | Ashcroft et al. ..... 180/6.48 |
| 6,135,566 | A | | 10/2000 | Anderson |
| 6,299,257 | B1 | | 10/2001 | Constantino |
| 6,523,906 | B1 | | 2/2003 | Holder |
| 6,540,305 | B2 | | 4/2003 | Phillips |

FOREIGN PATENT DOCUMENTS

| | | |
|---|---|---|
| CA | 2537720 | 5/2007 |
| WO | 98/24997 | 6/1998 |
| WO | 00/12307 | 3/2000 |

* cited by examiner

*Primary Examiner*—Jimmy G Foster

(57) ABSTRACT

A hydraulically powered self-propelled stripping machine having an electric motor for providing oscillating motion to a cutting head member. The electric motor driving a hydraulic pump for pumping hydraulic fluid to a hydraulic motor for driving the wheels of the hydraulically powered self propelled stripping machine. The hydraulic system having forward and reverse as well as speed control valves for controlling the direction and speed of the hydraulically powered wheels or for stopping. The hydraulically powered self-propelled stripping machine also having a hydraulic pressure safety valve for protecting the machine and the objects it engages from damage.

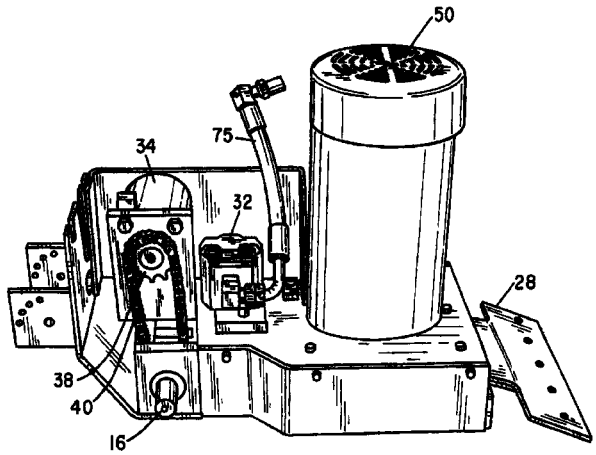

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 3-18:

The self propelled floor stripping machine 10 has a main body portion 45 having a cutting head member 28 in the front for removing carpeting and other objects attached to a floor or other generally flat surface. The cutting head member 28 is driven by electric motor 50 and is mechanically connected thereto by a shaft having an eccentric portion for moving the cutting head member 28 in an orbital motion. For a detailed view of such a mechanical connection see U.S. Pat. No. 6,135,566, which is hereby attached hereto and made a part hereof by reference. *As shown in FIG. 2 of the '566 patent, the motor shaft 88 passes through a bearing 86 in the main body plate 12 and connects to the eccentric shaft 132 to move the cutting blade in an oval orbit at a repetition rate determined by rpm of the electric motor, the reference numerals being those used in the '566 patent.* As best seen in FIG. 2, the drive wheels 14 are powered by a hydraulic motor 34 which turns sprocket wheel 38 connected to drive chain 40 which is connected to drive shaft 16 on which wheel 14 is mounted. The hydraulic motor 34 is powered by a hydraulic connection between the hydraulic motor 34 and pump 32. Pump 32 is driven by a mechanical connection to electric motor 50.

AS A RESULT OF REEXAMINATION, IT HAS BEEN DETERMINED THAT:

Claims 3, 4, 12 and 17 are cancelled.

Claims 1, 2, 6, 8, 10, 13-15 and 22 are determined to be patentable as amended.

Claims 5, 7, 9, 11, 16 and 18-21, dependent on an amended claim, are determined to be patentable.

New claims 23-41 are added and determined to be patentable.

1. A self-propelled, walk-behind floor stripping machine for removing adhesively bonded floor coverings comprising:

a main body having a drive axle and a pair of drive wheels affixed to the drive axle;

a floor engaging cutting head member attached to the main body;

an electric motor mounted on said main body and mechanically connected to the cutting head member to provide [a] *an orbital* motion thereto *at a repetition rate determined by the rpm of the electric motor*;

a hydraulic pump attached to the main body and coupled to be driven by the electric motor, the hydraulic pump coupled to a hydraulic fluid reservoir attached to the main body, the hydraulic pump having a suction inlet coupled to the hydraulic fluid reservoir, and a pressure outlet coupled through a hydraulic valve *system* to a hydraulic motor attached to the main body at a location offset from the drive axle, the hydraulic motor having an output shaft coupled to said drive axle for driving the pair of drive wheels *at a speed determined by a hydraulic valve system setting*.

2. The self-propelled, walk-behind floor stripping machine of claim 1 wherein the hydraulic valve *system* controls the direction of rotation of the pair of drive wheels.

6. The self-propelled, walk-behind floor stripping machine of claim 5 where the hydraulic valve *system* and hydraulic lines connected thereto are in the handle.

8. A self-propelled, walk-behind floor stripping machine for removing adhesively bonded floor coverings as in claim 1 wherein, a pressure safety valve *in* the hydraulic valve system relieves pressure in the hydraulic system.

10. A self-propelled, walk-behind floor stripping machine, comprising:

a frame;

an axle having a pair of ground-engaging wheels thereon journaled for rotation on the frame;

a scrapper blade assembly resiliently mounted to the frame;

an electric motor mounted to the frame for imparting oscillatory, *orbital* movement to the scrapper blade assembly *with a repetition rate determined by the rpm of the electric motor*;

a hydraulic circuit including a hydraulic pump, a hydraulic fluid reservoir, a hydraulic motor and a control valve mechanism, the hydraulic pump being driven by the electric motor to circulate hydraulic fluid from the hydraulic fluid reservoir to the hydraulic motor via the control valve mechanism; and the hydraulic motor being affixed to the frame at a location offset from the axle and coupled in driving relation to the axle *to drive the ground engaging wheels at a speed determined by the control valve mechanism*.

13. The self-propelled, walk-behind floor stripping machine of claim [12] *10* wherein a safety valve in the hydraulic valve mechanism relieves pressure in the hydraulic circuit.

14. The self-propelled, walk-behind floor stripping machine of claim [12] *11* wherein a valve in the hydraulic circuit provides hydraulic fluid flow from the pump to the tank while the electric motor powering the pump is running to lower the hydraulic fluid temperature and let the electric motor run cooler.

15. The self-propelled, walk-behind floor stripping machine as in claim 11 wherein a handle is attached to the [main body] *frame* for steering.

22. A self-propelled, walk-behind floor stripping machine for removing adhesively bonded floor coverings comprising:

a main body having a drive axle and a pair of drive wheels affixed to the drive axle;

a floor engaging cutting head member attached to the main body;

an electric motor mounted on said main body and mechanically connected to the cutting head member to provide a motion thereto;

a hydraulic pump attached to the main body and coupled to be driven by the electric motor, the hydraulic pump coupled to a hydraulic fluid reservoir attached to the main body, the hydraulic pump having a suction inlet coupled to the hydraulic fluid reservoir, and a pressure outlet coupled through a hydraulic valve *system* to a hydraulic motor attached to the main body at a location displaced from the drive axle, the hydraulic motor having an output shaft coupled to said drive axle for driving the pair of drive wheels, a handle having a first end attached to the main body, the handle having a second end with a first handle bar and a second handle bar on opposite sides of the handle,

[an] *the* hydraulic valve system *being disposed* in the handle, a first hydraulic line running from the hydraulic pump to the hydraulic valve system, to provide pressurized hydraulic fluid to the hydraulic valve system, a second hydraulic line running from the hydraulic valve system, to the hydraulic reservoir to return the hydraulic fluid to the hydraulic reservoir, a third hydraulic line running from the hydraulic valve system, to the motor for delivering hydraulic fluid for running the motor in a first direction, or returning the hydraulic fluid to the hydraulic valve system, a fourth hydraulic line running from the hydraulic valve system, to the motor for delivering hydraulic fluid for running the motor in a second direction, or returning the hydraulic fluid to the hydraulic valve system, the first handle bar having an electrical switch connected to a solenoid for activating a control valve in the hydraulic valve system to run the hydraulic motor in the first direction, the second handle bar having an electrical switch [for] connected to the solenoid for activating the control valve in the hydraulic valve system to run the hydraulic motor in the second direction.

*23. A self-propelled, walk-behind floor stripping machine for removing adhesively bonded floor coverings comprising:*

*a main body having a drive axle and a pair of drive wheels affixed to the drive axle;*

*a floor engaging cutting head member attached to the main body;*

*a single electric motor mounted on said main body with a motor output shaft oriented vertically and perpendicular to the main body and mechanically connected to the cutting head member beneath the main body to provide an orbital motion thereto;*

*a hydraulic pump attached to the main body and coupled to be driven by the electric motor, the hydraulic pump having a suction inlet coupled to a hydraulic fluid reservoir attached to the main body, and a pressure outlet coupled through a hydraulic valve system to a hydraulic motor attached to the main body at a location offset from the drive axle, the hydraulic motor having an output shaft coupled to said drive axle for driving the pair of drive wheels at a speed determined by a hydraulic valve system setting.*

*24. The self-propelled, walk-behind floor stripping machine of claim 23 wherein the hydraulic valve system controls the direction of rotation of the pair of drive wheels.*

*25. The self-propelled, walk-behind floor stripping machine of claim 23 where a handle is attached to the main body for steering and handle bars are attached to the handle.*

*26. The self-propelled, walk-behind floor stripping machine of claim 25 where the hydraulic valve system and hydraulic lines connected thereto are in the handle.*

*27. A self-propelled, walk-behind floor stripping machine for removing adhesively bonded floor coverings as in claim 23 wherein,*

*a speed control valve in the hydraulic valve system regulates the speed of the hydraulic motor.*

*28. A self-propelled, walk-behind floor stripping machine for removing adhesively bonded floor coverings as in claim 23 wherein,*

*a pressure safety valve in the hydraulic valve system relieves pressure in the hydraulic system.*

*29. A self-propelled, walk-behind floor stripping machine for removing adhesively bonded floor coverings as in claim 23 wherein,*

*an electrical switch on the handle to turn on or turn off electricity running to the electric motor.*

*30. A self-propelled, walk-behind floor stripping machine, comprising:*

*a frame;*

*an axle having a pair of ground-engaging wheels thereon journaled for rotation on the frame;*

*a scrapper blade assembly resiliently mounted to the frame;*

*a single electric motor mounted to the frame with its motor output shaft oriented vertically and mechanically coupled to the scraper blade assembly beneath the frame for imparting oscillatory orbital movement to the scrapper blade assembly;*

*a hydraulic circuit including a hydraulic pump, a hydraulic fluid reservoir, a hydraulic motor and a control valve mechanism, the hydraulic pump being driven by the electric motor to circulate hydraulic fluid from the hydraulic fluid reservoir to the hydraulic motor via the control valve mechanism; and*

*the hydraulic motor being affixed to the frame at a location offset from the axle and coupled in driving relation to the axle.*

*31. The self-propelled, walk-behind floor stripping machine of claim 30 wherein the control valve mechanism controls the direction of rotation of the pair of ground-engaging wheels.*

*32. The self-propelled, walk-behind floor stripping machine of claim 31 wherein the control valve mechanism controls the speed of rotation of the pair of drive wheels.*

*33. The self-propelled, walk-behind floor stripping machine of claim 32 wherein*

*a safety valve in the hydraulic valve mechanism relieves pressure in the hydraulic circuit.*

*34. The self-propelled, walk-behind floor stripping machine of claim 32 wherein*

*a valve in the hydraulic circuit provides hydraulic fluid flow from the pump to the tank while the electric motor powering the pump is running to lower the hydraulic fluid temperature and let the electric motor run cooler.*

*35. The self-propelled, walk-behind floor stripping machine as in claim 31 wherein a handle is attached to the frame for steering.*

*36. The self-propelled, walk-behind floor stripping machine as in claim 35 wherein,*

*the control valve mechanism is in the handle.*

*37. The self-propelled, walk-behind floor stripping machine of claim 30 wherein the hydraulic valve mechanism controls the speed of rotation of the pair of ground engaging wheels.*

*38. The self-propelled, walk-behind floor stripping machine as in claim 30 and further including a handle member coupled at a first end to the frame and having first and second hand grips at a second end thereof and wherein said control valve mechanism and hydraulic lines are mounted in the handle.*

*39. The self-propelled, walk-behind floor stripping machine as in claim 38 wherein the control valve mechanism includes solenoid-operated cartridge valves and first and second control switches coupled in circuit with the solenoid-operated cartridge valves, the control switches being disposed on the first and second hand grip members, respectively.*

*40. The self-propelled, walk-behind floor stripping machine as in claim 39 wherein the control valve mechanism circulates hydraulic fluid from the hydraulic pump to the hydraulic fluid reservoir when neither of the first and second control switch is actuated.*

*41. The self-propelled, walk-behind floor stripping machine as in claim 38 wherein the control valve mechanism includes a control device for regulating the rate of flow of hydraulic fluid from the hydraulic pump to the hydraulic motor.*

* * * * *